United States Patent [19]

Sahlin

[11] 3,969,798

[45] July 20, 1976

[54] BLANKS FOR COFFINS

[75] Inventor: Anders Lennart Sahlin, Vallingby, Sweden

[73] Assignee: Anders Sahlin AB, Vallingby, Sweden

[22] Filed: Jan. 23, 1974

[21] Appl. No.: 435,792

[30] Foreign Application Priority Data

Jan. 23, 1973 Sweden ..... 7300930

[52] U.S. Cl. ..... 27/4

[51] Int. Cl.[2] ..... A61G 17/00

[58] Field of Search ..... 27/2, 3, 4, 35, 5–7; 229/14 R, 41 R, 41 B, 41 C, 41 D, 23 C

[56] References Cited

UNITED STATES PATENTS

| | | | |
|---|---|---|---|
| 2,693,894 | 11/1954 | Elmendorf | 229/23 C |
| 3,220,080 | 11/1965 | Connelly | 27/2 |
| 3,490,114 | 1/1970 | Connelly | 27/2 |
| 3,574,906 | 4/1971 | Rittenhouse | 27/4 |

FOREIGN PATENTS OR APPLICATIONS

| | | | |
|---|---|---|---|
| 1,190,760 | 5/1970 | United Kingdom | 27/4 |

*Primary Examiner*—John D. Yasko
*Attorney, Agent, or Firm*—Fred Philpitt

[57] ABSTRACT

A blank for a coffin or for a top or bottom part of a coffin, comprising a plurality of largely flat sections limited by essentially straight lines, which sections can be folded in relation to each other along interlying borderlines and joined together to form the intended shape. Each and every one of the said sections comprises a flex-rigid sheet applied to a relatively thin layer forming the outer surface of the coffin. The layer forming said outer surface is made of a flexible material with high tensile strength and extends over the entire outer surface of the blank. Further, said layer constitutes the only connection between the sheet sections of which the blank is comprised.

6 Claims, 8 Drawing Figures

BLANKS FOR COFFINS

This invention relates to a blank for a coffin or for a top or bottom part of a coffin, which requires a minimum of space for storage and transport and which, among other things, is suitable for storage for emergency purposes, examplewise for catastrophes and natural disasters, etc.

One type of coffin previously proposed for this purpose comprises two halves which are stackable in each other. Another type consists of a finished bottom part with a top part made in the form of a flat blank, Both of these types require a relatively large amount of storage space. Previously suggested coffins, which have been storable and which are made up of essentially flat blanks, usually have several layers of corrugated board with bevelled folding creases. These coffins have a rigidity which is vastly inferior to that of conventional wooden coffins and do not give the same distinct transitions between the various surfaces of the coffin as these. Among other disadvantages, it is usually difficult to achieve a simple and reliable sealing of the coffins and practicable carrying grips without utilizing extra parts.

The primary object of the present invention is to provide a blank for a coffin or for a top or bottom part of a coffin, which is essentially flat and which can be built into the intended shape with a few simple manipulations. The formed coffin shall moreover have a very rigid structure, comparable with now common wooden coffins.

Other objects are to provide a blank which permits production of a coffin that gives essentially the same visual impression as a conventional wooden coffin, is simple to close and features practicable carrying means.

These objects are satisfied according to the invention in that the blank is made in the form of a number of separate rigid sheet sections applied to a relatively thin but strong material layer forming the limiting surfaces of the coffin. In assembling the coffin the said sheet sections can then be folded relative to each other, utilizing the outer layer as a joint. The sheet sections are so dimensioned and arranged that when the coffin is put together their edge faces will be pressed hard against each other and against stiffeners mounted along the edges, under the influence of tensions in the outer layer.

The specifically distinguishing features of the invention are evident from the claims.

A more detailed description of the invention, wherein refence is made to the accompanying drawings, will now be given.

Figures 1A, 1B:
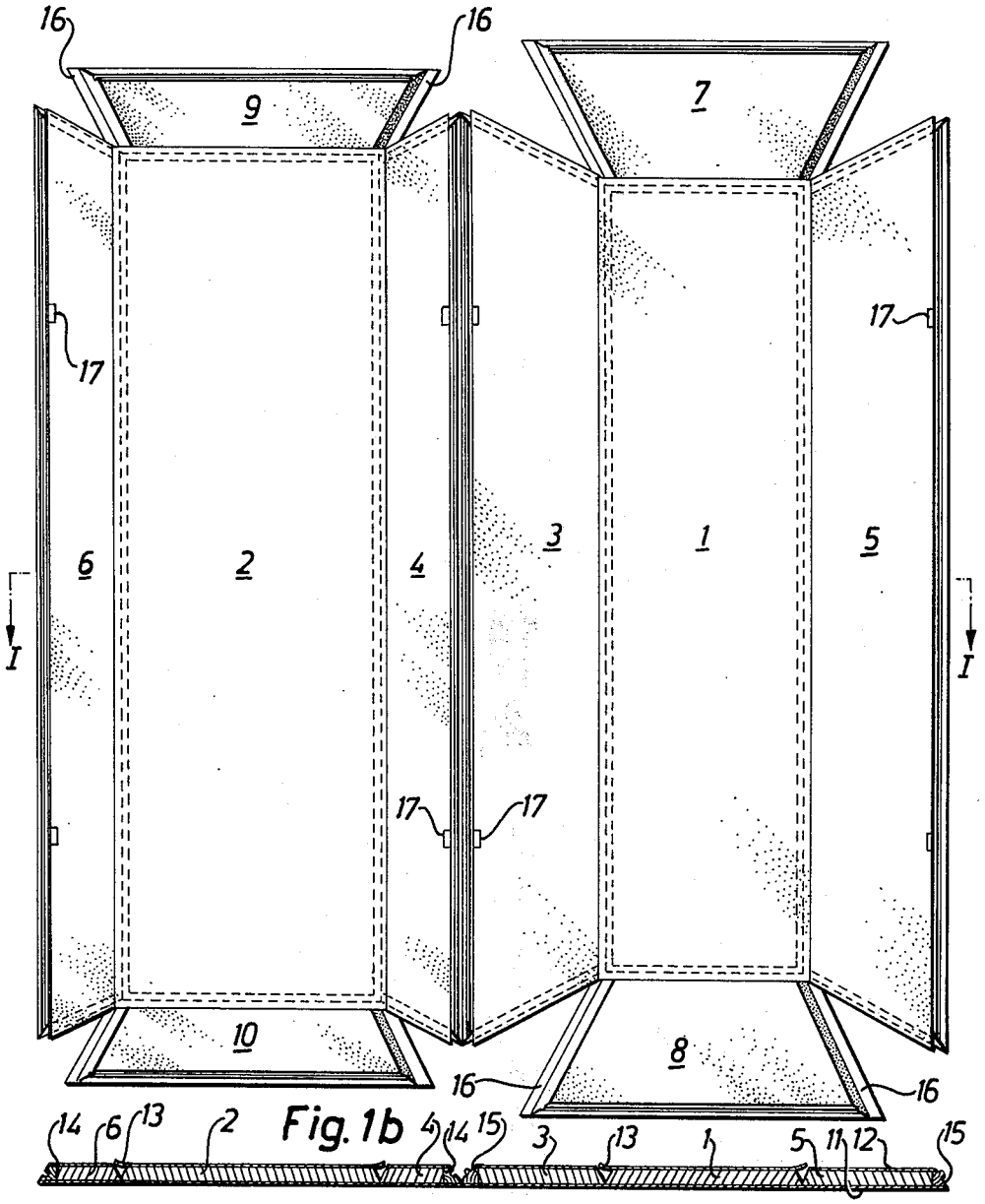
FIG. 1A is a horizontal view of a completely unfolded blank for a coffin according to a first embodiment.
FIG. 1B is a section through the blank according to FIG. 1A along the line I—I.
Figure 2:
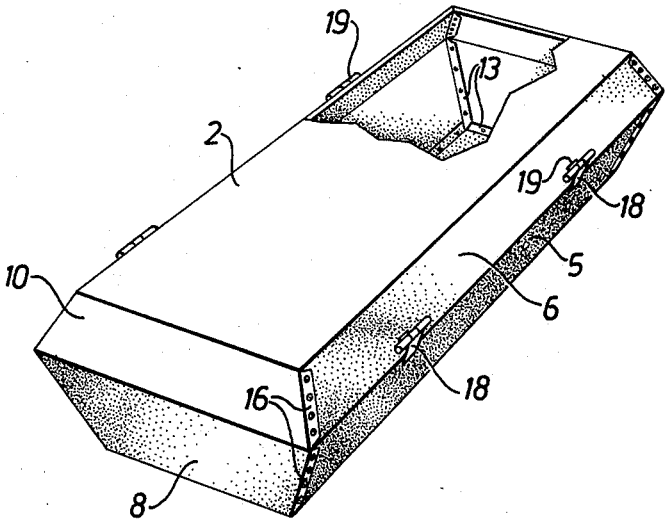
FIG. 2 is a perspective view of a coffin assembled from a blank according to FIG. 1A and 1B.

The blank shown in FIG. 1A and 1B and made in one piece is intended for a coffin according to FIG. 2., with a conventional appearance. The blank comprises a rectangular bottom section 1 and a similarly rectangular top section 2. Located between the said sections are two parallel-trapezoidal sections 3 and 4, each of which forms a part of one side area of the coffin. The rectangular sections 1 and 2 also border at their three other edges onto parallel-trapezoidal sections 5–10, which when the coffin is assembled each form a part of its other side area or of its two end areas.

The blank according to FIG. 1A is held together by an outer layer 11 made in one piece on which, as is evident from FIG. 1B, sheets corresponding to the said sections are applied, appropriately by glueing. The outer layer must be of a flexible but highly strong material, for example a readily degradable, plastic-treated textile or cardboard material. The sheets must in contrast be rigid and light-weight and are thus appropriately made of porous material. Particularly suitable are those layered or sandwich material which consist of two outer, rigid sheets and an interlying, transversely located cardboard construction of corrugated or honeycomb type. Sheets constructed in this manner are very light and torsionally rigid. Moreover, they possess the advantage of being readily degradable in nature or easily burnable.

As is best seen from FIG. 1B, a thin material layer 12 is applied to the upper surface of the said sheets. The layers applied to the bottom section 1 and top section 2 respectively overlap these sections in such a manner that when the coffin is assembled they will be folded up along the adjoining side and end sections. Also the layers applied to the side sections 3–6 overlap these sideways so that when the coffin is assembled the can be folded in inside the end sections 7–10. The overlapping flaps 13 can be glued, taped or riveted to adjoining sections, which not only affords an excellent seal but also has a highly favourable effect on the stability of the coffin.

Figure 3:
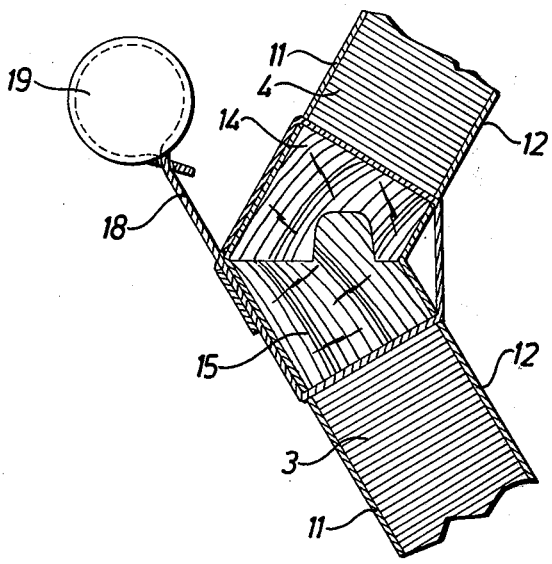
FIG. 3 is a part of a section through the assembled coffin at a sealing band serving as a carrying handle.

The end areas of the section 3–10 forming the side and end areas of the coffin which when the coffin is assembled will rest against each other are, as shown in the section according to FIG. 3, provided with stiffeners 14 and 15 mounted on the said edges, which stiffeners have a lengthwise groove and respectively a tongue mating with this groove. Other edge surfaces of the different sections are bevelled in break lines of the coffin.

As is evident from FIG. 1A, the layer 11 which forms the outer surface of the coffin overlaps the end sections 7–10 of the coffin. Thus here also flaps 16 are formed, which when the coffin is assembled are folded round the adjacent corner and attached to the adjoining side surface, appropriately in the same manner as the flaps 13 of the aforesaid inner layer 12. The various sections are so dimensioned and applied to the outer layer 11 in relation to each other that when the coffin is assembled relatively large tensile stresses appear in the said layers, which results in the sheet sections of the finished coffin being pressed firmly against one another. This, in combination with the interconnecting effect of the aforesaid flaps 13 and 16 and the stiffeners 14 and 15 arranged around the opening of the coffin and meshing with each other, results in high stability and torsional rigidity of the finished coffin. If so desired, the joint between the said stiffeners can be glued in connection with closing of the coffin. The coffin assembled from the described blank will be very difficult to distinguish from a conventional wooden coffin, especially if the outer layer 11 is given a wood-imitation surface.

In order further to improve the assemblage of the coffin and to provide practicable carrying handles on this pairwise opposite slits 17 are arranged at the stiffeners 14 and 15 mounted along the edges of the side sections of the coffin, which slits are intended to receive sealing and carrying bands 18, which can be inserted through the slits in the manner shown in FIG. 3. One end of the band is then fitted with a carrying handle 19 or suitable construction. If so desired, the stiffeners 14 and 15 along the edges of the end sections 7-10 of the coffin can also be provided with corresponding slits 17 intended for reception of sealing bands 18. The said bands are preferably made of a strong fibre material and provided with a suitable locking device.

Figure 4A:
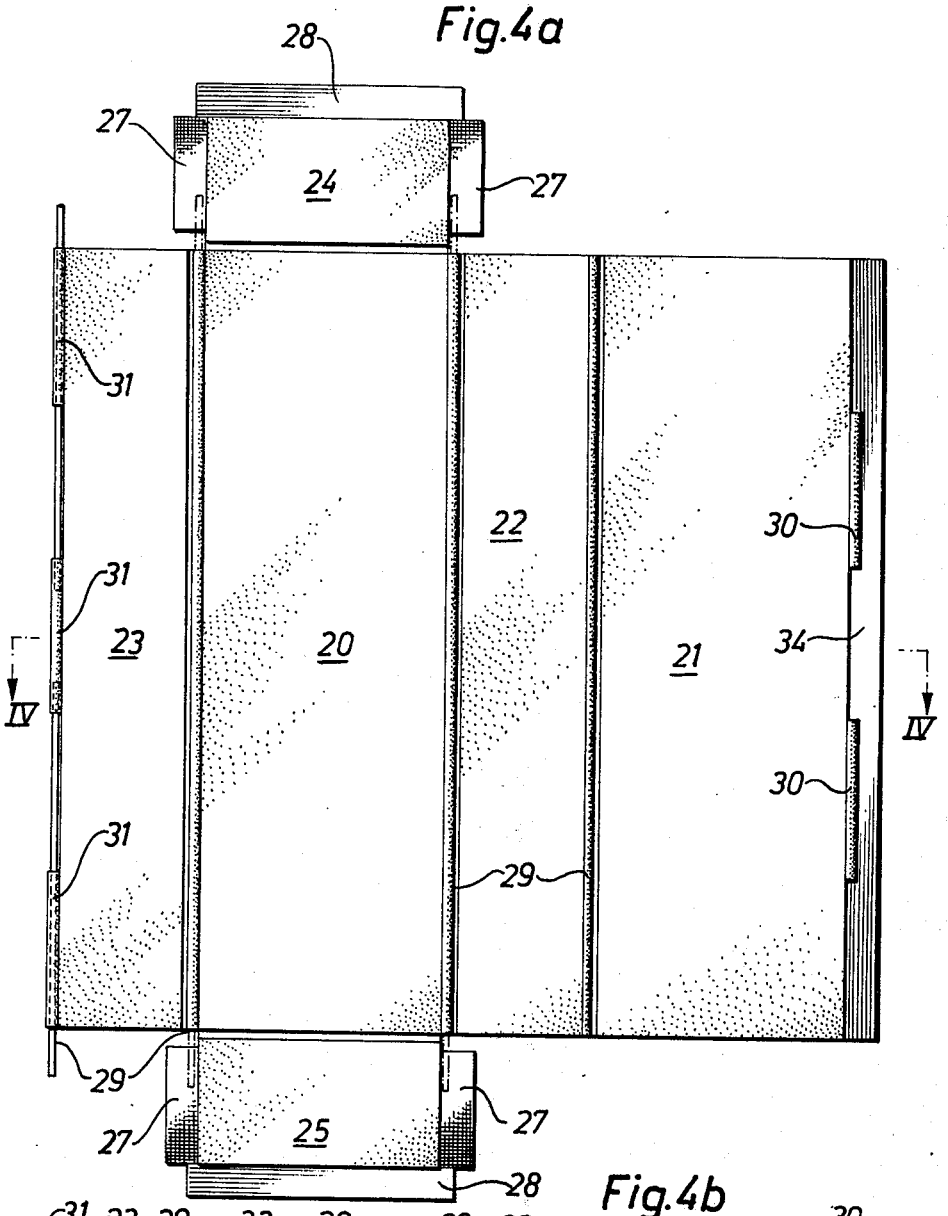
FIG. 4A is a horizontal view of a flat blank for a coffin according to a second embodiment.
Figure 4B:
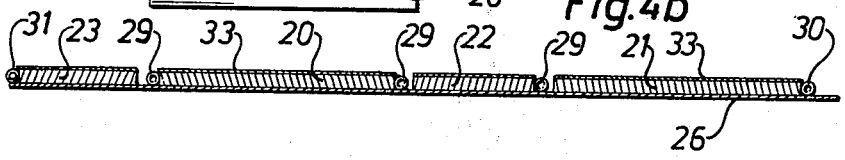
FIG. 4B is a section through the blank according to FIG. 4A along the line IV—IV.
Figure 6:
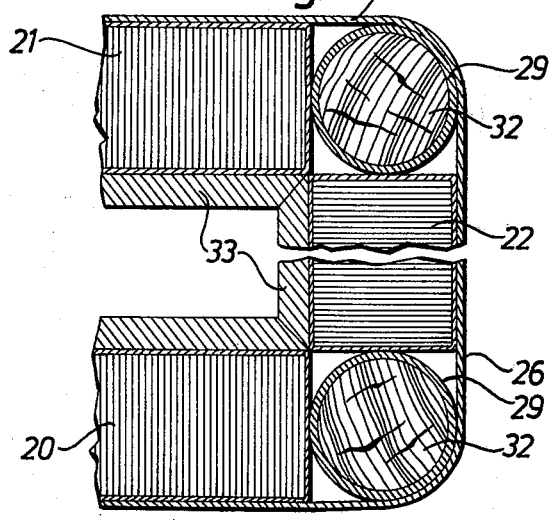
FIG. 6 is a part of a section through the coffin according to FIG. 5.
Figure 5:
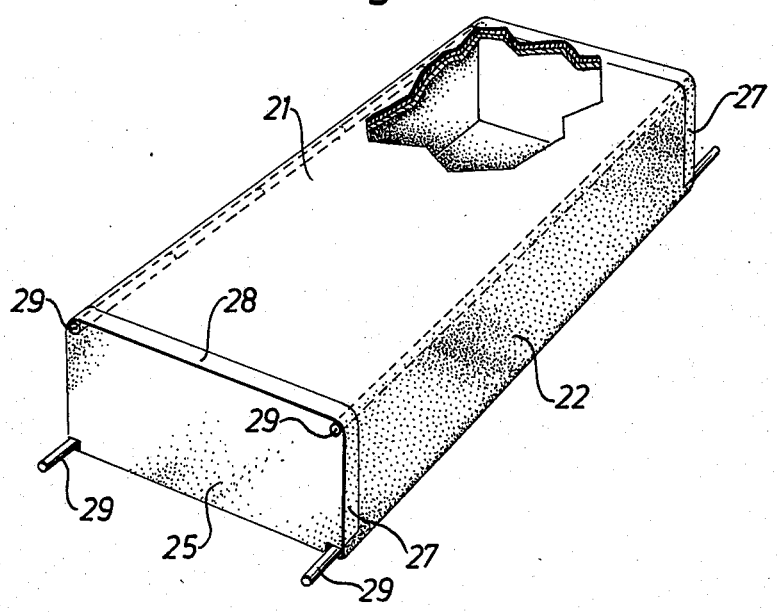
FIG. 5 is a perspective view of a coffin assembled from a blank according to FIG. 4A and 4B.

The blank shown in FIG. 4A and 4B is intended for forming of a coffin according to FIG. 5, which is specially intended to be stored for utilization in connection with catastrophes, natural disasters and the like. The blank comprises six rectangular sections 20–25, of which section 20 is intended to form the bottom and section 21 the top of the coffin. Sections 22 and 23 form the sides and sections 24 and 25 the ends of the coffin. The said sections, in this elaboration also, consist of rigid, low-weight sheets, which are applied to a flexible and highly strong material layer 26 which is made in one piece and which will form the outer surface of the coffin. The said layer overlaps the end sections 24 and 25 along three sides and also extends beyond the free edge of the top section 21. The thus formed flaps 27, 28 and 34 are appropriately provided on the inside with a glue layer covered with protective tape strips.

A stiffener 29 is applied in each and every one of the transitions between the sections 20–23. The stiffeners applied along the side edges of the bottom section 20 are made slightly longer than the actual bottom area, so that they can serve as carrying handles for the assembled coffin. The free edges of sections 21 and 23 are provided with tunnel sections 30 and 31 respectively, which are so located that when the coffin is assembled they form an essentially continuous tunnel along the entire length of the coffin. The coffin can then be closed by insertion of yet another stiffener 29 through the said tunnel. This stiffener can, as is indicated in FIG. 4A, appropriately be made in two halves, which are inserted one from each end of the coffin. All stiffeners can consist of rigid cardboard tubes into which — if necessary — round wooden rods 32 can be inserted as reinforcements. the said carrying handles can then consist of such wooden rods insertable in cardboard tubes.

As is seen from FIG. 4B, the insides of the sheets are provided with a thin layer 33, appropriately of a soft and absorbent material. When the coffin is assembled, this will be pressed together in the corners and achieve the necessary sealing at the corners. Alternatively, the inside of the blank can be covered with plastic foil in such a manner that a completely tight coffin is obtained.

The said sheet sections 20–25 are so dimensioned and applied to the outer layer 26 that when the coffin is assembled great tensile stresses will be transmitted in the outer layer around the stiffeners 29 provided at the corners, which permits firm fixation of the said sheets. This, in combination with the stiffening effect achieved when the end sections 24 and 25 are folded up and attached to the sides of the coffin by means of the said flaps 27, results in a finished coffin of high stability and torsional rigidity.

The invention thus enables coffins to be formed from essentially flat blanks, which coffins are very light and stable and can be given such an appearance that they completely resemble conventional wooden coffins. Further, the material consumption for the coffin will be very small, a further advantage being that wood and paper can be utilized throughout as materia, which means that the coffin will be degraded in nature or be burnable without leaving a residue of pollutive impurities or metal parts.

The blanks for coffins described above can be varied in numerous respects. Among other things, their geometrical shape can be altered to provide coffins of different designs. Moreover, the shown blanks can be divided into two parts, on for the top of the coffin and one for its bottom. A common feature of the described embodiments is that they are composed of a number of sheet sections held together by an outer layer, which sections in the finished coffin are held together by the said layer, forming a highly rigid unit on account of the tensile stresses transmitted in the layer.

What is claimed is:

1. A blank for a coffin consisting essentially of the combination of a thin outer layer of a flexible material with high tensile strength forming the entire outer surface of the coffin, a plurality of rigid sheet sections attached to various portions of the inner side of said outer layer of flexible material, which rigid sheet sections are intended to be folded in an unobstructed edge-to-edge relationship to each other along lines parallel to their adjacent edges and directly abut against each other to form a coffin cavity using said flexible outer layer as a combined pivot and connecting member to hold the edges of said rigid sections together under tension in direct edge-to-edge abutting relationship, said outer surface extending beyond the sections forming the sides of the coffin so as to make flaps which can be fastened to the outer sides of the coffin, each of said rigid sheet sections having its inner surface covered with separate thin layers of material that extend beyond the edges of each rigid section so as to form outwardly extending edge flaps, the outwardly extending edge flaps of one rigid sheet section being fastened to the adjacent rigid sheet section when the coffin is assembled so as to both form a seal between adjacent rigid sheet sections and to lend structural stability to the coffin.

2. A blank according to claim 1 wherein the edges of said rigid sheet sections are contoured so that they will nest together when the coffin is erected under the influence of the tension forces exerted by the thin layer of flexible material.

3. A blank for a coffin characterized by a. a plurality of largely flat sections defined by essentially straight lines, which sections can be folded in relation to each other along interlying borderlines and joined together to form a coffin of the intended shape, b. a relatively thin layer forming the outer surface of the coffin, c. each of said flat sections comprising a rigid sheet, each rigid sheet being attached to said thin layer, d. said relatively thin layer being composed of a flexible material with high tensile strength and extending over the entire outer surface of the blank and constituting the only connection between the rigid sheets, e. said plurality of flat sections including two rectangular sections forming the top and bottom respectively of the coffin and which at their edges border onto sections that, when the coffin is assembled, form parts of its sides and ends, and f. lengthwise stiffeners mounted on the edges of the side-forming sections which, when the coffin is assembled, will rest against each other in the transition between the top and bottom part of the coffin and are elaborated with a lengthwise groove and a tongue corresponding to the groove.

4. A blank according to claim 3, wherein the stiffeners which are mounted on the sections forming the sides of the coffin are provided with pairwise opposite slits intended to receive bands intended for holding together and lifting of the coffin.

5. A blank according to claim 3, wherein the end surfaces of the sheets included in the sections which are not provided with stiffeners are bevelled in order when the coffin is assembled to form stable joints under the influence of tensile forces in the outermost layer of the blank.

6. A blank for a coffin characterized by a. a plurality of largely flat sections defined by essentially straight lines, which sections can be folded in relation to each other along interlying borderlines and joined together to form a coffin of the intended shape, b. a relative thin layer forming the outer surface of the coffin, c. each of said flat sections comprising a rigid sheet each rigid sheet being attached to said thin layer, d. said relatively thin layer being composed of a flexible material with high tensile strength and extending over the entire outer surface of the blank and constituting the only connection between the rigid sheets, e. said plurality of flat sections including two rectangular sections forming the top and bottom respectively of the coffin, between which a rectangular section forming one side of the coffin is located, wherein the section forming the bottom of the coffin borders at its three other edges onto three rectangular sections, which form the other side and respectively the ends of the coffin, the two sections forming the sides being elaborated to be folded in assembly of the coffin around stiffeners provided along the side edges of the bottom section, the stiffeners being mounted along the edges of the bottom-forming section being somewhat longer than the bottom of the coffin for formation of carrying handles.

* * * * *